US007114434B2

(12) United States Patent
Kanai

(10) Patent No.: US 7,114,434 B2
(45) Date of Patent: Oct. 3, 2006

(54) RECIPROCATING COMPRESSOR

(75) Inventor: Hiroshi Kanai, Saitama (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 53 days.

(21) Appl. No.: 10/514,124

(22) PCT Filed: May 24, 2003

(86) PCT No.: PCT/JP02/13788

§ 371 (c)(1),
(2), (4) Date: Nov. 12, 2004

(87) PCT Pub. No.: WO03/095834

PCT Pub. Date: Nov. 20, 2003

(65) Prior Publication Data

US 2005/0169769 A1 Aug. 4, 2005

(30) Foreign Application Priority Data

May 14, 2002 (JP) ..... 2002-137980

(51) Int. Cl.
*F01B 13/04* (2006.01)
*F04B 39/02* (2006.01)

(52) U.S. Cl. ..... 92/12.2; 92/57; 92/71; 92/153; 417/269

(58) Field of Classification Search ..... 92/12.2, 92/57, 71, 153; 417/269
See application file for complete search history.

(56) References Cited

U.S. PATENT DOCUMENTS 4,283,997 A 8/1981 Takahashi et al.
5,580,224 A 12/1996 Ikeda et al.
5,636,974 A * 6/1997 Ikeda et al. ..... 92/154
5,733,107 A * 3/1998 Ikeda et al. ..... 92/154
5,997,257 A 12/1999 Ishida et al.
6,582,202 B1 * 6/2003 Fujii et al. ..... 417/269

FOREIGN PATENT DOCUMENTS

JP 49-25732 A 7/1974
JP 58-131380 A 8/1983
JP 03-70878 A 3/1991
JP 2000-18154 A 1/2000

OTHER PUBLICATIONS

International Search Report mailed on Mar. 25, 3003.

* cited by examiner

*Primary Examiner*—Igor Kershteyn
(74) *Attorney, Agent, or Firm*—Rader, Fishman & Grauer PLLC

(57) ABSTRACT

A reciprocating compressor, comprising a cylinder block (1) having a cylinder bore (12) formed therein, a rear head (3) fixed to the cylinder block through a valve plate (2) and having a suction chamber (26) and a discharge chamber (27) formed therein, a front head (4) fixed to the cylinder block (1) and having a crankcase (6) formed therein, pistons (13) reciprocatingly sliding in the cylinder bore according to the rotation of a shaft (7) installed so as to pass through the crankcase (6), a means for separating lubricating oil mixed in working fluid discharged into the discharge chamber (27), and an oil tank (30) for storing the lubricating oil separated by the oil separation means, wherein the lubricating oil stored in the oil tank (30) is cooled by working fluid sucked from the outside and led into the suction chamber (26), whereby the durability of sliding portions can be increased by effectively cooling the lubricating oil in the compressor to assure excellent lubrication at the sliding portions.

11 Claims, 6 Drawing Sheets

(a)

(b)

(a)

(b)

RECIPROCATING COMPRESSOR

This application is a U.S. National Phase Application under 35 USC 371 of International Application PCT/JP02/13788 filed Dec. 27, 2002.

TECHNICAL FIELD

The present invention relates to a reciprocating compressor ideal in an application in a supercritical freezing cycle in which a coolant such as $CO_2$ (carbon dioxide) is used as a working fluid, and more specifically, it relates to a reciprocating compressor adopting a structure that makes it possible to separate lubricating oil mixed in the compressed working fluid and keep the separated lubricating oil within the compressor.

BACKGROUND ART

The pressure in a supercritical freezing cycle in which $CO_2$ (carbon dioxide) is used as the coolant rises to a level approximately 10 times as high as the pressure in a freezing cycle in which a Freon coolant is used. For this reason, as the coolant is compressed inside a cylinder bore, the temperature of the discharged coolant, too, increases due to the raised discharge pressure, and since this lowers the viscosity of the lubricating oil, the lubrication at sliding portions becomes poor, which leads to a problem of poor durability of the sliding portions. Further problems may arise if the lubricating oil becomes degraded due to the heat or if the lowered viscosity causes sliding portions to seize.

This issue is addressed in the related art with a structure disclosed in Japanese Unexamined Patent Publication No. 2000-18154, in which degradation of the lubricating oil and the occurrence of a seize are prevented by forming a continuous hollow portion around a plurality of cylinder bores formed at a cylinder block, supplying a feedback coolant (a cooling medium), which is taken in via a suction port, into the hollow portion and preventing the temperature inside the bores from rising to an excessive extent during the compression phase through active heat exchange of the heat inside the individual cylinder bores and the feedback coolant.

However, while the structure described above is advantageous in that the cylinder bores are cooled to a sufficient degree, it simply cools down the lubricating oil by cooling the cylinder bores. Thus, when the lubricating oil mixed in the discharged coolant is separated and is directly returned to the crankcase, the temperature of the returning lubricating oil will be high. As a result, good lubrication will not be achieved in the crankcase due to the presence of a significant quantity of lubricating oil with lowered viscosity, which gives rise to a concern for lowered durability of the sliding portions. In addition, there is a concern in that the cylinder bores with the hollow portion formed around them in the structure described above may become deformed readily as the descending loads of the pistons are applied.

Accordingly, a main object of the present invention is to provide a reciprocating compressor that achieves improved durability in the sliding portions by effectively cooling the lubricating oil inside the compressor and assuring good lubrication at the sliding portions. Further objects of the present invention are to assure effective cooling of the cylinder bores and the pistons and to prevent deformation of the bores, which tends to occur readily when a hollow portion is formed around the cylinder bores.

DISCLOSURE OF THE INVENTION

In order to achieve the objects described above, the reciprocating compressor according to the present invention comprising a cylinder block having a plurality of cylinder bores formed therein, a valve plate having formed therein pairs of holes, each pair constituted of a suction hole and a discharge hole in correspondence to one of the cylinder bores, a first head fixed to the cylinder block via the valve plate and having formed therein a suction chamber that is allowed to communicate with the suction holes and a discharge chamber that is allowed to communicate with the discharge holes, a second head fixed to the cylinder block and having formed therein a crankcase, a shaft rotatably passing through the crankcase and pistons that slide back and forth inside the cylinder bores as the shaft rotates, is characterized in that an oil separation means that separates lubricating oil mixed in a working fluid discharged to the discharge chamber and an oil tank at which the lubricating oil having been separated by the oil separation means is collected are provided and that the lubricating oil collected at the oil tank is cooled with a working fluid taken in from the outside and guided into the suction chamber.

Since the lubricating oil having been separated from the discharge gas by the oil separation means is collected in the oil tank and is then cooled with the uncompressed, relatively cool working fluid which is taken in from the outside and is guided into the suction chamber, the viscosity of the lubricating oil collected in the oil tank can be sustained at a high level to assure better lubrication.

It is desirable that part of the oil tank is disposed at the cylinder block and that a suction path through which the working fluid flows is formed at the cylinder block so as to surround the oil tank.

By adopting the structure described above, it becomes possible to cool the oil tank with a high degree of efficiency as the working fluid guided into the suction chamber is caused to flow around the oil tank while it flows through the suction path at the cylinder block.

More specifically, the suction path should include a suction port through which the working fluid is taken in from the outside, a chamber formed to surround the oil tank at the cylinder block and open toward the valve plate, a first passage which communicates between the suction port and the chamber and a second passage formed at the valve plate so as to communicate between the chamber and the suction chamber.

Alternatively, part of the oil tank may be disposed at the first head with the suction chamber formed so as to surround the oil tank at the first head. In addition, the oil separation means may include an oil separation chamber communicating with the discharge chamber, may separate the lubricating oil centrifugally in the oil separation chamber by rotating the working fluid flowing in from the discharge chamber and may allow the oil separation chamber to partially overlap the oil tank so as to achieve communication.

It is to be noted that the chamber in the structure described above may be formed so as to surround the cylinder bores as well. In such a case, it is possible to cool the inside of the cylinder bores.

Furthermore, if the suction path is formed by retaining tubular walls around the oil tank and the cylinder bores, it is desirable to bridge the tubular walls with reinforcement ribs in order to prevent deformation of the cylinder bores, which would otherwise be caused by the descending loads of the pistons.

Based upon the structure described above through which the lubricating oil is actively cooled, the lubricating oil may be supplied through two supply path systems so as to supply the lubricating oil to portions that need to be lubricated with a high degree of efficiency. Namely, a control passage, the degree of openness of which is adjusted with a pressure control valve, may be formed between the discharge chamber and the crankcase, a first lubricating oil supply path which opens up an end of the control passage facing the crankcase toward a peripheral edge of a swashplate and a second lubricating oil supply path through which the lubricating oil having been collected in the oil tank is supplied to lubrication-requiring portions around the shaft via a passage formed at the shaft may be provided, and the crankcase and the chamber may be made to communicate with each other via a leak passage formed at the cylinder block.

In the structure described above, the working fluid containing the lubricating oil, which is discharged into the discharge chamber, is directly supplied toward the peripheral edge of the swashplate connected to the pistons via the first lubricating oil supply path. In addition, the lubricating oil having been separated from the working fluid and collected at the oil tank is directly supplied to the lubrication-requiring portions around the shaft, e.g., a shaft seal member sealing the area between the second head and the shaft. Thus, the lubricating oil is supplied to various lubrication-requiring portions via the appropriate lubricating oil supply paths.

Alternatively, a control passage, the degree of openness of which is adjusted with a pressure control valve, may be formed between the discharge chamber and the crankcase, a first lubricating oil supply path which opens up an end of the control passage facing the crankcase toward a peripheral edge of a swashplate and a second lubricating oil supply path through which the lubricating oil having been collected in the oil tank is supplied to lubrication-requiring portions around the shaft via a passage formed at the cylinder block and the second head and a passage formed at the shaft communicating with the passage and the crankcase and the chamber at the cylinder block and the second head may be provided, may be made to communicate with each other via the passage formed at the shaft and a leak passage formed at the cylinder block which communicates with the passage at the shaft.

In this structure, too, the working fluid containing the lubricating oil, which is discharged into the discharge chamber, is directly supplied toward the peripheral edge of the swashplate connected to the pistons via the first lubricating oil supply path. In addition, the lubricating oil having been separated from the working fluid and collected at the oil tank is directly supplied to the lubrication-requiring portions around the shaft, e.g., a shaft seal member sealing the area between the second head and the shaft. Thus, the lubricating oil can be supplied to various lubrication-requiring portions via the appropriate lubricating oil supply paths.

It is to be noted that if tightening bolts are used to fasten the cylinder block, the valve plate, the first head and the second head together as an integrated unit, the tightening bolts should be disposed further outside relative to the cylinder bores at positions with the same phase as that of the cylinder bores so as to ensure that there is no obstacle in the suction path. In addition, it is desirable to assure a high level of pressure withstanding performance and a high level of airtightness by disposing a greater number of tightening bolts than the number of cylinder bores. Moreover, a sub-suction chamber where the working fluid flowing in from the suction port is stored may be formed between the suction port and the chamber in order to reduce the extent of suction pulsation.

While the structure described above is ideal in an application in a standard compressor in the related art, i.e., a compressor having the first head constituting a rear head and the second head constituting a front head, it may also be adopted in a compressor having the first head constituting a front head and the second head constituting a rear head.

BEST MODE FOR CARRYING OUT THE INVENTION

Figure 1:
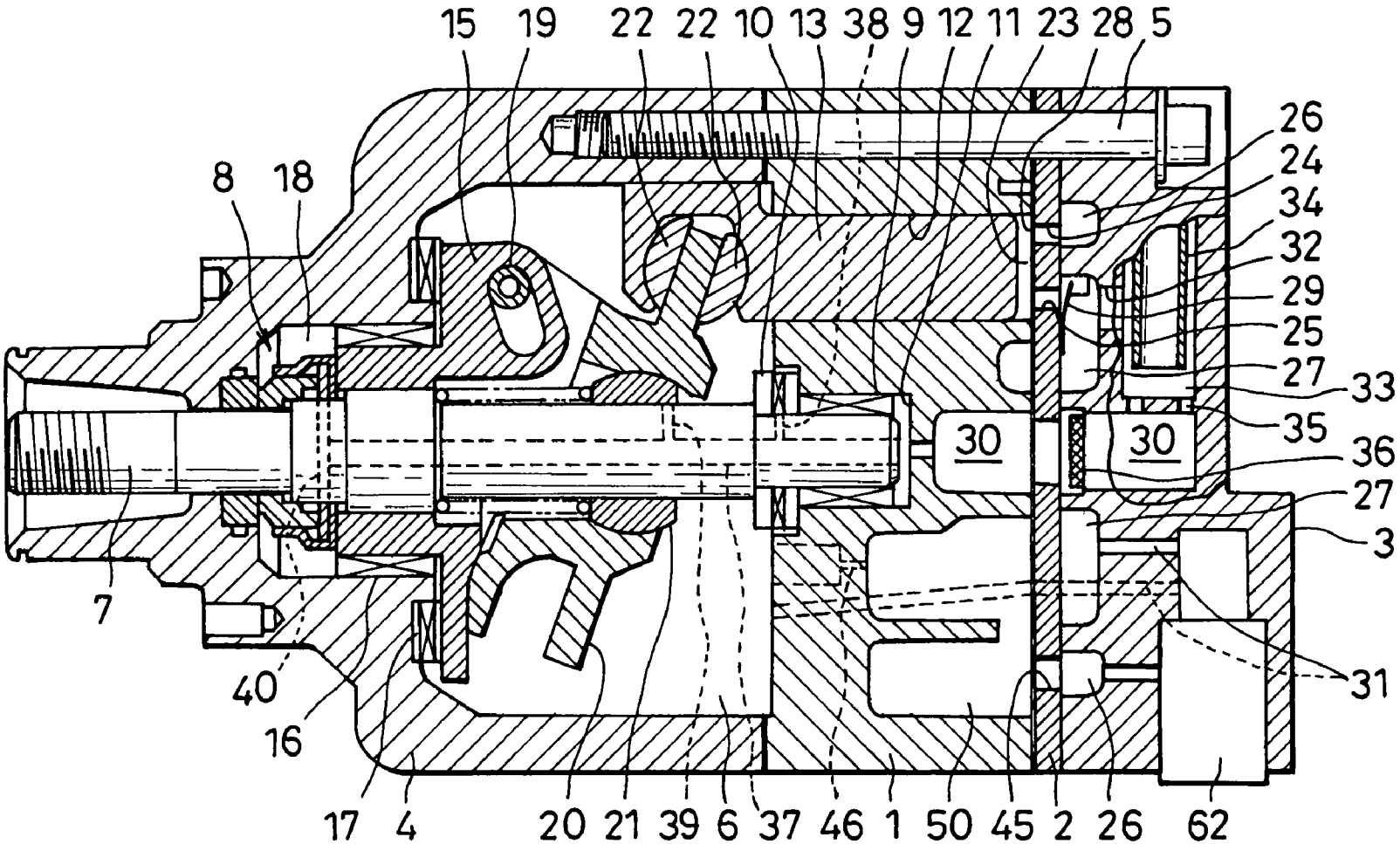
FIG. 1 is a sectional view of a reciprocating compressor according to the present invention, taken along line I—I in FIG. 2.

The following is an explanation of embodiments of the present invention, given in reference to the drawings. The reciprocating compressor in FIGS. 1 and 2, which is employed in a supercritical freezing cycle that uses a coolant such as $CO_2$ (carbon dioxide) or the like as a working fluid, comprises a cylinder block 1, a rear head 3 mounted on the rear side (the right side in the figures) of the cylinder block 1 via a valve plate 2 and a front head 4 mounted so as to close off the front side (the left side in the figures) of the cylinder block 1. The front head 4, the cylinder block 1, the valve plate 2 and the rear head 3 are fastened together along the axial direction with tightening bolts 5 thereby constituting a housing for the entire compressor.

In a crankcase 6 formed by mounting the front head 4 at the cylinder block 1, a shaft 7 with one end thereof projecting out from the front head 4 to be fixed to the armature of an electromagnetic clutch (not shown) is housed. The shaft 7 is rotatably supported on the same end side via a thrust flange 15 by a radial bearing 16 and a thrust bearing 17 housed in the front head 4, whereas the other end of the shaft 7 is rotatably supported by a radial bearing 9 and a thrust bearing 10 housed in the cylinder block 1.

At the cylinder block 1, a bearing housing chamber 11 in which the radial bearing 9 and the thrust bearing 10 are housed and a plurality (6) of cylinder bores 12 disposed over equal intervals in a circle around the shaft so as to surround the shaft 7 are formed. Inside each cylinder bore 12, a single-ended piston is inserted so as to slide reciprocally. It is to be noted that in this example, the tightening bolts 5 are each provided further outward relative to a cylinder bore at a position with the same phase as that of the cylinder bore 12, i.e., on an extension of a straight line that connects the shaft 7 and the cylinder bore 12.

The thrust flange 15 that rotates together with the shaft 7 is fixed to the shaft 7 in the crankcase. The thrust flange 15 is disposed so as to form a shaft seal chamber 18 where the shaft seal device constituted with a mechanical seal 8 is housed between the front head 4 and the thrust flange 15 on its front end side supported with the radial bearing 16.

In addition, a swashplate 20 is connected to the thrust flange 15 via a link mechanism 19. The swashplate 20 supported so as to be allowed to tilt around a hinge ball 21 which is fitted at the shaft 7 with play, rotates as one with the thrust flange 15 in synchronization with the rotation of the thrust flange 15. The swashplate is held at the tail portions of single-ended pistons 13 projecting out into the crankcase 6 via a pair of shoes 22 disposed so as to enclose the peripheral edge of the swashplate 20 from the front and the rear. Thus, as the shaft 7 rotates causing the swashplate 20, too, to rotate, the rotating motion of the swashplate 20 is converted to a reciprocal linear motion of each single-ended piston 13 via the shoes 22, and the reciprocal motion of the single-ended pistons 13 alters the volumetric capacity of a compression space 23 formed inside the cylinder bore 12 between the single-ended piston 13 and the valve plate 2.

Figure 3:
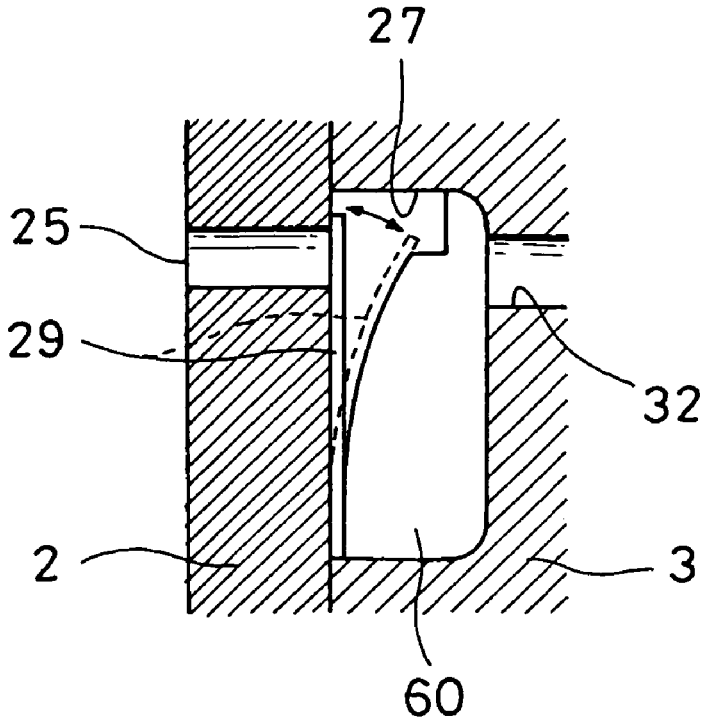
FIG. 3 is an enlarged view of the discharge chamber, provided to facilitate an explanation of the relationship between the stopper 60 formed as an integrated part of the rear head 3 and the discharge valve 29.

Pairs of holes each constituted of a suction hole 24 and a discharge hole 25 are formed in the valve plate 2 in correspondence to the individual cylinder bores 12, and a suction chamber 26 where the working fluid to be supplied to the compression spaces 23 is stored and a discharge chamber 27 where the working fluid discharged from the compression spaces 23 is collected are formed at the rear head 3. The suction chamber 26, which is formed continuously around the discharge chamber 27, communicates with the compression spaces 23 via the suction holes 24 at the valve plate 2, whereas the discharge chamber 27, which is formed continuously around and oil tank 30 detailed below, communicates with the compression spaces 23 via the discharge holes 25 at the valve plate 2. In addition, the suction holes 24 are each opened/closed with a suction valve 28 disposed at the end surface of the valve plate 2 on the front side, and the discharge holes 25 are each opened/closed with a discharge valve 29 disposed at the end surface of the valve plate 2 on the rear side. As shown in FIG. 3, a stopper 60 formed as an integrated part of the rear head 3 regulates the lift quantity of the discharge valve 29 when it is opened, and in this example in particular, the durability of the discharge valve 29 is assured by forming the surface of the stopper 60 facing opposite the discharge valve 29 so that the distance from the discharge hole 25 lengthens gradually as it ranges toward the free end of the discharge valve 29 and thus by allowing the discharge valve 29 and the stopper 60 to achieve surface content.

A control passage 31 communicating between the bottom portion of the discharge chamber 27 and the crankcase 6 is formed at the cylinder block 1, the valve plate 2 and the rear head 3, and a pressure control valve 62 with which the degree of openness of the control passage 31 is adjusted is disposed at the rear head 3. The pressure control valve 62 is used to control the crankcase pressure by adjusting the state of communication between the discharge chamber 27 and the crankcase 6 so as to set the suction chamber pressure to a desired level. With the pressure control valve 62, the difference between the crankcase pressure and the pressure inside the cylinder bores applied to the front and the rear of the single-ended pistons 13 is adjusted, thereby also adjusting the tilt angle of the swashplate 20 to enable control of the stroke of the single-ended pistons 13, i.e., the discharge capacity. In addition, the end of the control passage 31 facing the crankcase 6 is formed so as to open toward the peripheral edge of the swashplate 20 that slidably contacts the shoes 22, and the control passage 31 forms a first lubricating oil supply path.

An oil separation means that separates the lubricating oil mixed in the working fluid discharged into the discharge chamber 27 through centrifugal separation is provided at the rear head 3. The oil separation means includes an oil separation chamber 33 that communicates with the upper portion of the discharge chamber 27 via a communicating passage 32 in the rear head 3. The oil separation chamber 33 is a space formed to range along the vertical direction, and inside the oil separation chamber 33, a gas guiding tube 34 is disposed so as to descend from the top. As the working fluid guided into the oil separation chamber 33 via the communicating passage 32 is guided downward while rotating around the gas guiding tube 34, the lubricating oil mixed in the working fluid becomes separated. Then, the working fluid from which the lubricating oil has been separated flows out through a discharge port (not shown) via the gas guiding tube 34, whereas the lubricating oil having become separated is collected into the oil tank 30 located below the oil separation chamber 33 via an oil outlet hole 35 formed at the bottom of the oil separation chamber 33. Reference 36 indicates a dust removing filter disposed inside the oil tank 30.

Figure 4:
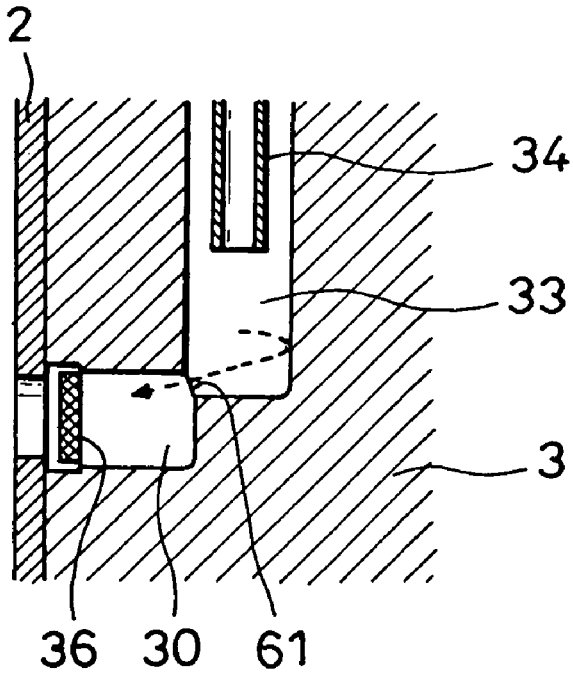
FIG. 4 shows another structural example that may be adopted to communicate between the oil separation chamber 33 and the oil tank 30.

It is to be noted that while the oil separation chamber 33 is located above the oil tank 30 and the oil separation chamber 33 and the oil tank 30 are made to communicate with each other via the oil outlet hole 35 in the example, the oil separation chamber 33 may instead be formed so as to partially overlap with the oil tank as shown in FIG. 4 with the oil separation chamber 33 and the oil tank 30 achieving communication with each other through an opening 61 formed with a portion of the internal peripheral surface of the oil separation chamber 33 made to open into the oil tank 30. More specifically, it is desirable to allow the lower end of the oil separation chamber 33 to partially overlap the oil tank 30 and by adopting this structure, the lubricating oil (indicated with a dotted arrow) traveling downward while rotating along the inner wall surface of the oil separation chamber 33 can be guided into the oil tank 30 with a high degree of efficiency. In addition, since this structure eliminates the need to form a special communicating hole to achieve communication between the oil separation chamber 33 and the oil tank 30, the compressor can be provided as a compact unit and the work efficiency can be improved as well.

The oil tank 30 is disposed so as to range from the rear head 3 through the valve plate 2 to the cylinder block 1, and the lubricating oil collected in the oil tank 30 is guided into an axial passage 37 formed at the shaft 7 and extending along the axial direction via the bearing housing chamber 11, is supplied from the axial passage 37 to lubrication-requiring portions around the shaft such as the thrust bearing 10, the peripheral surface of the shaft 7 against which the hinge ball 21 slides in contact and the shaft seal chamber 18 where the mechanical seal is housed via radial passages 38, 39 and 40 formed so as to extend radially from the axial passage 37, and then is allowed to flow out into the crankcase 6. The axial passage 37 and the radial passages 38 to 40 constitute a second lubricating oil supply path through which the lubricating oil is supplied from the oil tank 30 to the lubrication-requiring portions around the shaft.

Figure 2:
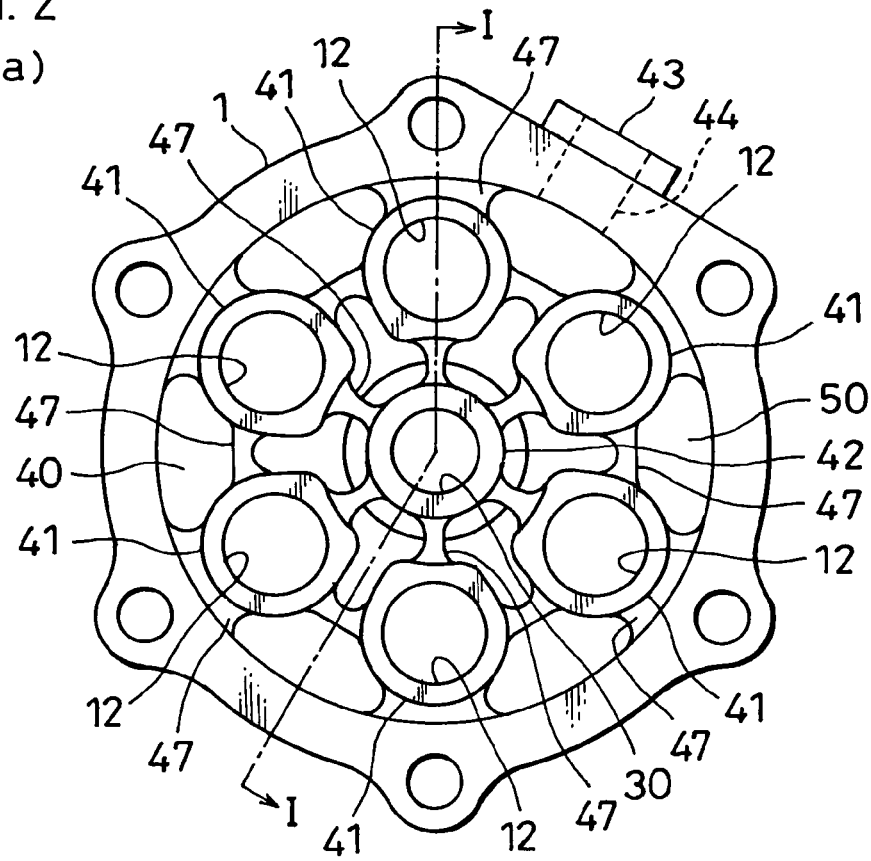
FIG. 2(*a*) shows an end surface of the cylinder block of the compressor shown in FIG. 1, viewed from the rear head side, and FIG. 2(*b*) shows an end surface of the valve plate in the compressor shown in FIG. 1.
Figure 2:
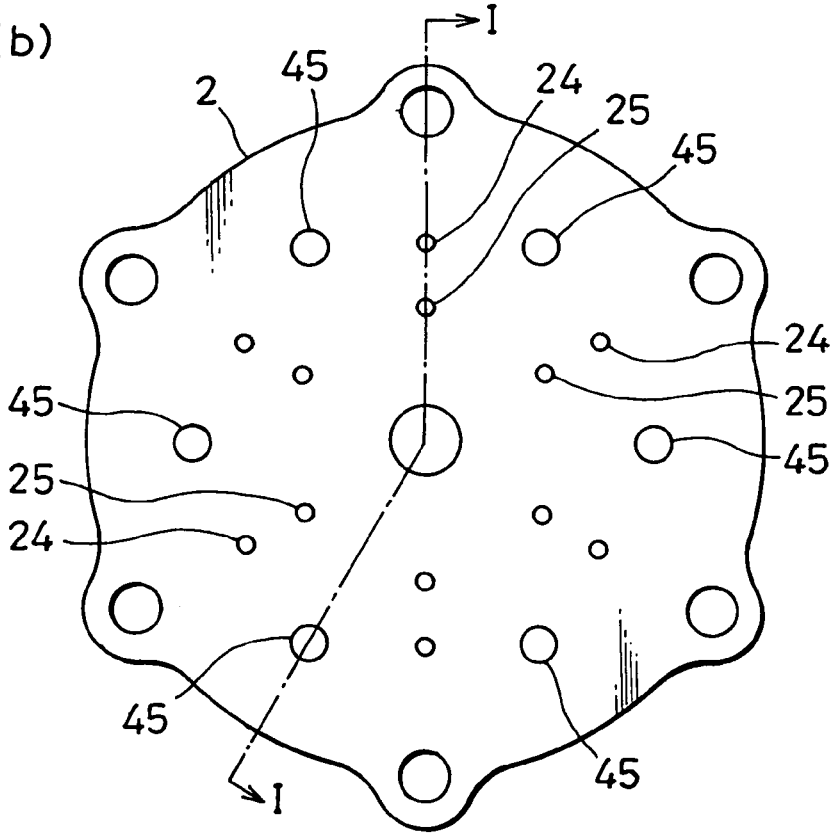

In the compressor, a continuous chamber 50 is formed so as to surround the individual cylinder bores 12 and the oil tank 30 in the cylinder block 1 as illustrated in FIG. 2. The chamber 50, which is formed by leaving tubular walls 41 and 42 around the oil tank 30 and the individual cylinder bores 12, is made to communicate with a suction port 43 formed at the cylinder block 1 via a first passage 44 and is made to communicate with the suction chamber 26 at the rear head 3 via a second passage 45 formed at the valve plate 2. The first passage 44, the chamber 55 and the second passage 45 constitute a suction path through which the working fluid is supplied so as to flow around the oil tank 30 and the cylinder bores 12. In addition, the crankcase 6 and the chamber 50 are made to communicate via a leak passage 46 formed as an orifice at the cylinder block 1, and thus, the crankcase pressure is gradually leaked into the chamber 50 (toward the suction chamber).

Furthermore, reinforcement ribs 47 are disposed at a height set by ensuring that the ribs 47 do not block the suction passage to bridge the neighboring tubular walls 41 and 42 defining the oil tank 30 and the cylinder bores 12 and also to bridge the tubular walls 41 defining the cylinder bores 12 and the inner wall of the cylinder block 1.

In the structure described above, the working fluid taken in through the suction port 43 flows into the chamber 50 via the first passage 44, passes around the cylinder bores 12 and the oil tank 30 to spread into the entire chamber 50 and is guided into the suction chamber 26 via the second passage 45. The working fluid guided into the suction chamber 26 is taken into the compression spaces 23 via the suction holes 24 during the descending stroke of the single-ended pistons 13, is compressed during the ascending stroke and is then discharged into the discharge chamber 27 via the discharge holes 25.

When the discharge chamber 27 and the crankcase 6 come into communication with each other via the control passage 31, the working fluid discharged into the discharge chamber 27, still containing the lubricating oil, is supplied to the peripheral edge of the swashplate 20. In addition, since the top portion of the discharge chamber 27 communicates with the oil separation chamber 33, the lubricating oil mixed in the working fluid becomes separated from the working fluid in the oil separation chamber 33 and the separated lubricating oil is collected into the oil tank 30. While the temperature of the lubricating oil guided into the oil tank is high, the lubricating oil collected in the oil tank is cooled down by the suction-side working fluid (the coolant fed back through the low-pressure line in the freezing cycle the temperature of which is relatively low) which flows through the chamber 50 in the cylinder block 1, and thus, the lubricating oil is actively cooled to keep its viscosity at a high level. Furthermore, since the chamber 50 surrounds the cylinder bores 12 as well, the cylinder bores 12 and the single-ended pistons 13 inserted at the cylinder bores, too, are cooled with the working fluid on the suction side.

The reinforcement ribs 47 disposed around the tubular walls 41 and 42 defining the oil tank 30 and the cylinder bores 12 prevent deformation of the cylinder bores 12 that would otherwise occur due to the descending load of the single-ended pistons 13 and thus, any structural weakness resulting from the presence of the chamber 50 is corrected. Moreover, since the tightening bolts 5 are disposed further outward relative to the cylinder bores at positions with the same phase as the phase of the cylinder bores 12, the tightening bolts 5 are not inserted inside the chamber 50 and do not block the flow of the working fluid.

The structure described above includes two lubricating oil supply path systems, i.e., the lubricating oil supply path through which the lubricating oil is supplied to the peripheral edges of the swashplate 20 via the control passage 31 and the lubricating oil supply path through which the lubricating oil collected in the oil tank 30 is supplied to the lubrication-requiring portions around the shaft via the passages formed at the shaft 7. As a result, the lubricating oil can be supplied to specific lubricating requiring portions in a desirable manner with a high degree of efficiency.

Namely, since the lubricating oil supplied to the sliding surfaces of the hinge ball 21 and the shaft 7 should be as pure as possible, the mechanical seal 8 seals the space between the front head 4 and the shaft 7 and the like, and the lubricating oil collected in the oil tank 30 is supplied directly to these portions, whereas the lubricating oil is sprayed via the control passage 31 onto the peripheral edges of the swashplate 20 that slides in contact against the shoes 22, thereby assuring a reliable lubricating oil supply to the swashplate 20. In this manner, the lubricating oil is supplied to the individual lubrication-requiring portions in a desirable manner.

It is to be noted that while the discharge chamber 27 is formed around the oil tank 30 and the suction chamber 26 is formed around the discharge chamber 27 in the structure described above, the positional relationship between the suction chamber 26 and the discharge chamber 27 may be reversed. When the positions of the suction chamber and the discharge chamber are reversed, the suction chamber 26 is formed so as to surround part of the oil tank 30 formed at the rear head 3 and, as a result, it becomes possible to cool the oil tank 30 while the working fluid flows inside the suction chamber 26 and in this case, the oil tank 30 can be cooled even more effectively by cooling the oil tank 30 from the two sides, i.e., from the cylinder block side and the rear head side.

Figure 5:
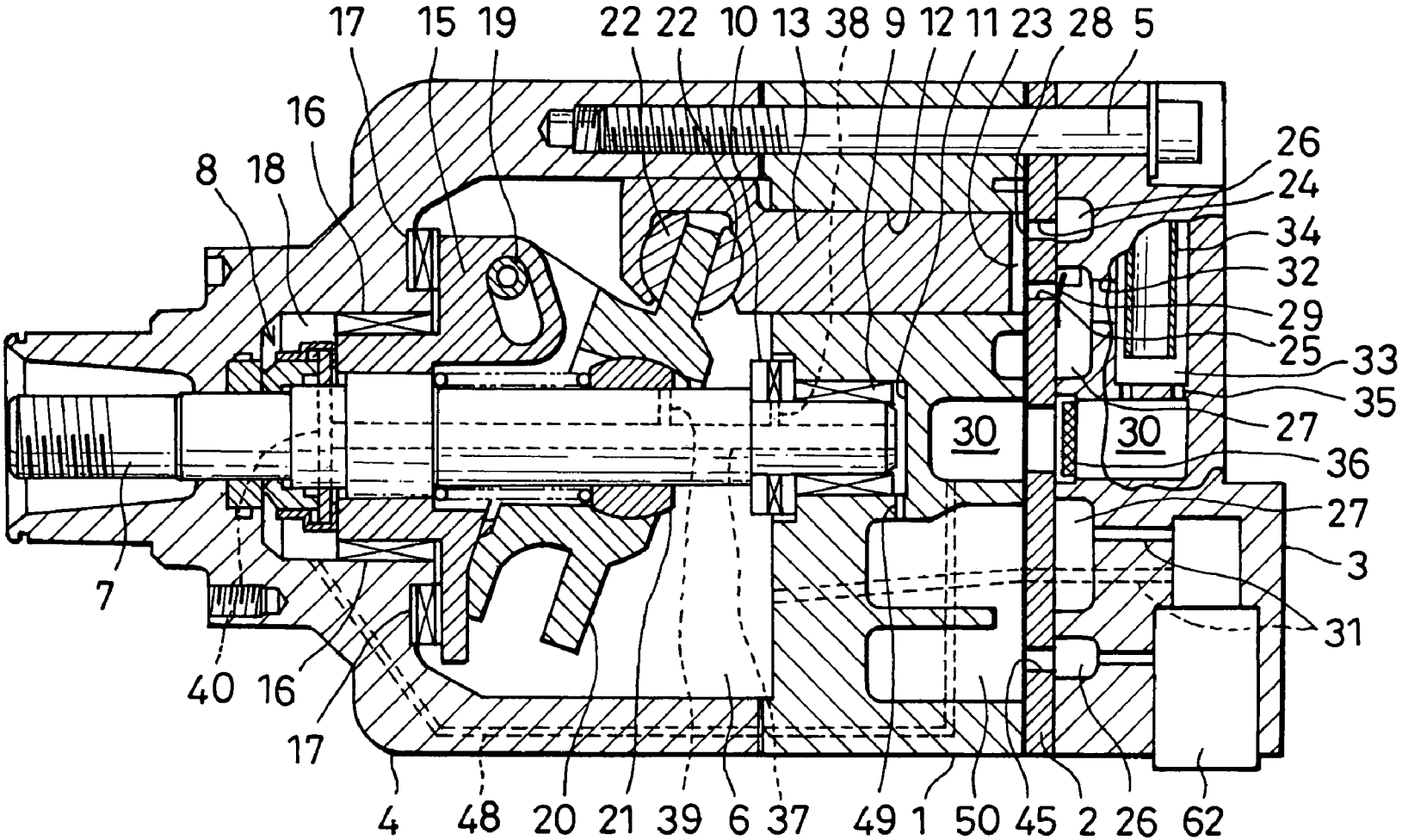
FIG. 5 is a sectional view of a reciprocating compressor according to the present invention, adopting different structures in the lubricating oil supply paths through which the lubricating oil is supplied from the oil tank and in the path through which the crankcase and the chamber communicate.

FIG. 5 presents an example of another structure that may be adopted in the lubricating oil supply paths. While the first lubricating oil supply path in this example assumes a structure similar to that shown in FIG. 1, the second lubricating oil supply path is formed with a passage having one end thereof communicating with the oil tank 30 and another end thereof communicating with the shaft seal chamber 18 housing the mechanical seal 8 via a housing passage 48 formed at the cylinder block 1 and the front head 4, an axial passage 37 formed at the shaft 7 along the axial direction and radial passages 38, 39 and 40 extending from the axial passage 37 along the radial direction to open at lubrication-requiring portions around the shaft such as the thrust bearing 10, the peripheral surface of the shaft 7 against which the hinge ball 21 slides in contact and the shaft seal chamber 18 housing the mechanical seal 8. As a result, the lubricating oil having been collected in the oil tank 30 is supplied to the shaft seal chamber 18 via the housing passage 48 formed at the cylinder block 1 and the front head 4, is guided into the crankcase 6 via the radial bearing 16 and the thrust bearing 17 disposed between the thrust flange 15 and the front head 4 from the shaft seal chamber 18 and is also guided to the other lubrication-requiring portions around the shaft from the radial passage 40 at the shaft 7 via the axial passage 37 and the other radial passages 38 and 39.

In addition, in this structural example, the bearing housing chamber 11 and the chamber 50 at the cylinder block 1 are made to communicate with each other via a leak passage 49 formed as an orifice at the cylinder block 1 and the crankcase 6 and the chamber 50 are made to communicate with each other via the thrust bearing 17 and the radial bearing 16 disposed between the thrust flange 15 and the front head 4, the shaft seal chamber 18, the passages formed at the shaft 7 (the radial passage 40 and the axial passage 37), the bearing housing chamber 11 and the leak passage 49 or via the thrust bearing 10 and the radial bearing 9 disposed between the shaft 7 and the cylinder block 1, the bearing housing chamber 11 and the leak passage 49. Thus, the crankcase pressure is ultimately leaked gradually into the chamber 50 (toward the suction chamber) via the leak passage 49. It is to be noted that since the other structural features are identical to those in the previous structural example, the same reference numerals are assigned to the identical features to preclude the necessity for a further explanation.

In this structure, too, the lubricating oil separated at the oil separation chamber 33 and collected into the oil tank 30 is cooled with the suction side working fluid (the coolant with a relatively low temperature fed back through the low-pressure line in the freezing cycle) flowing through the chamber 50 at the cylinder block 1, and the lubricating oil thus cooled is supplied to the lubrication-requiring portions around the shaft. Through the two lubricating oil supply path systems, i.e., the lubricating oil supply path through which the lubricating oil is supplied to the peripheral edges of the swashplate 20 via the control passage 31 and the path through which the lubricating oil in the oil tank 30 is supplied to the lubrication-requiring portions around the shaft via the second lubricating oil supply path, the lubricating oil can be supplied in a desirable manner to the individual lubrication-requiring portions to achieve a high degree of efficiency in the lubricating oil supply to the lubrication-requiring portions.

Figure 6:
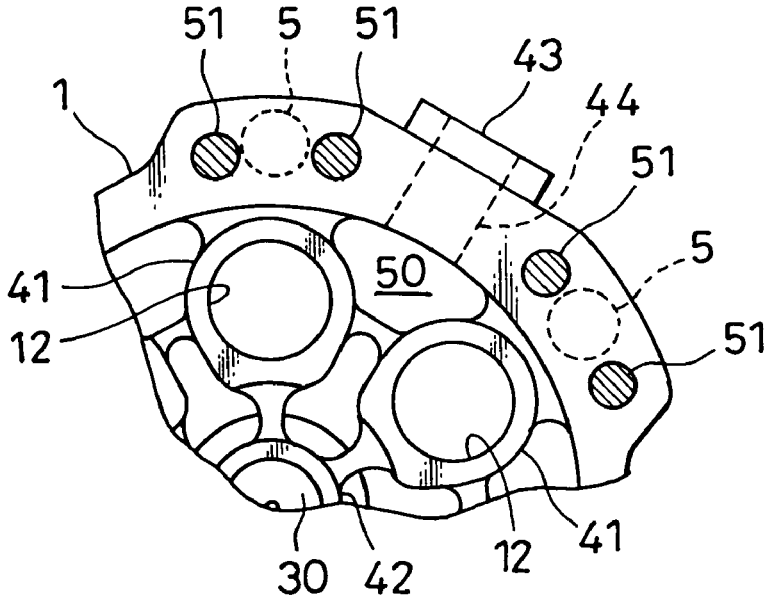
FIG. 6 shows part of the end surface of the cylinder block provided to facilitate an explanation of an example in which tightening bolts are disposed at different fastening positions.

While the compressor described above adopts a structure achieved by fastening the front head 4, the cylinder block 1, the valve plate 2 and the rear head 3 together by using the tightening bolts 5 disposed at positions achieving the same phase as the individual cylinder bores 12, a more compact compressor with a sufficient level of pressure withstanding performance and an airtight structure may be achieved by symmetrically disposing two tightening bolts 51 with a smaller diameter around each cylinder bore 12, instead of the tightening bolts 5 in the previous example indicated with dotted lines, as shown in FIG. 6. Since the number of tightening bolts 51 used in this structure is greater than the number of cylinder bores 12, the front head 4, the cylinder block 1, the valve plate 2 and the rear head 3 can be fastened together more evenly and more firmly. Furthermore, as the diameter of the tightening bolts 51 is reduced compared to the diameter of the tightening bolts in the related art, the overall diameter of the compressor itself can be reduced.

Figure 7:
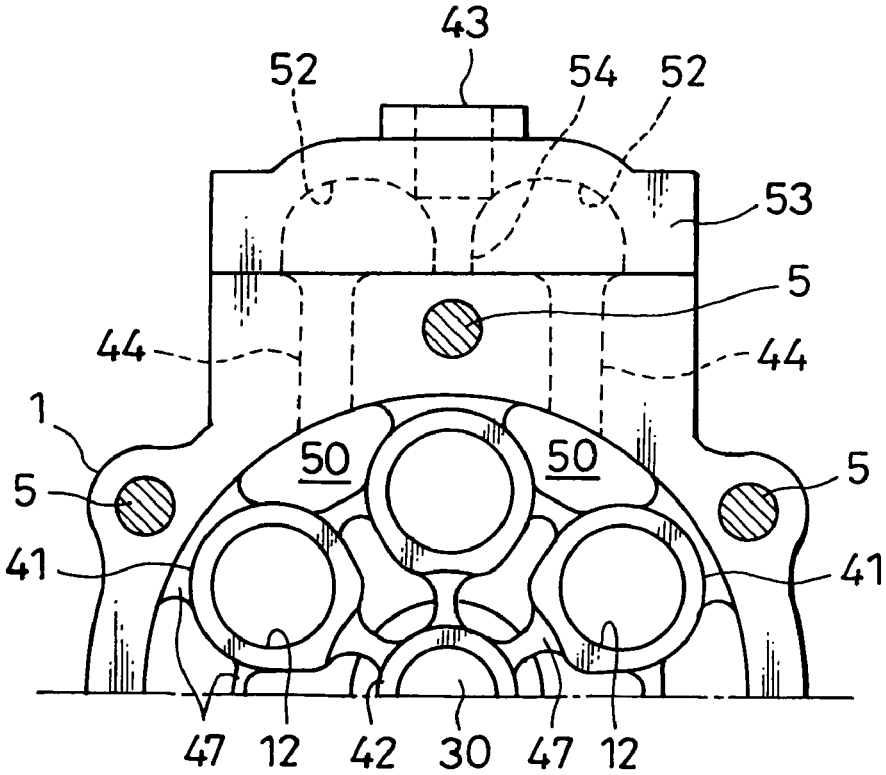
FIG. 7 illustrates a structure having sub-suction chambers disposed in the passage that communicates between the suction port and the chamber.
Figure 8:
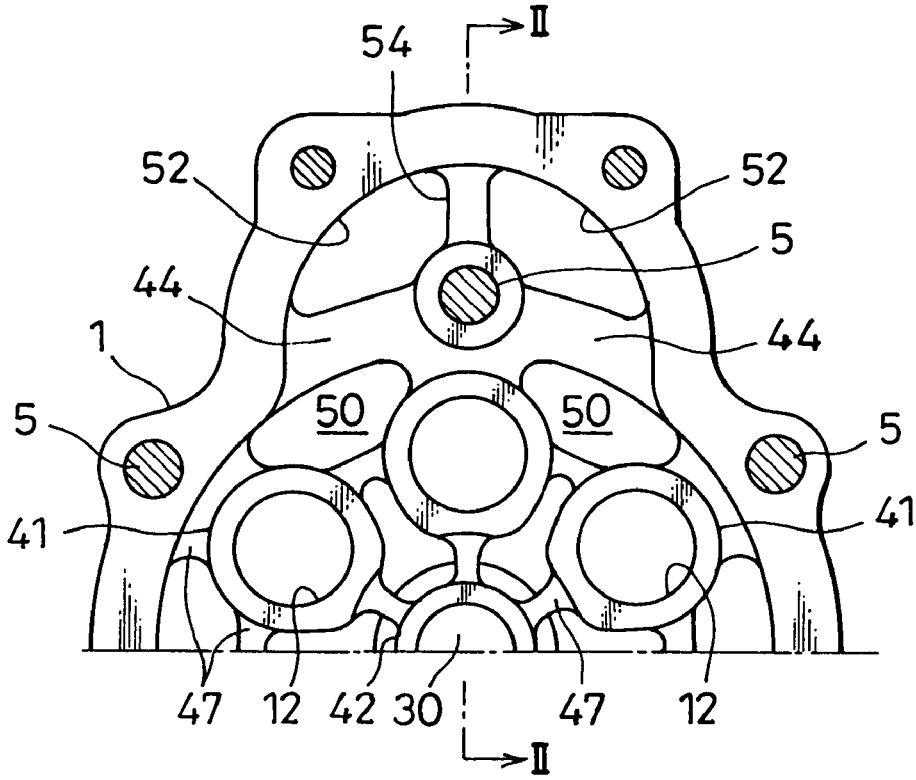
FIG. 8 shows another structure having sub-suctions chamber in a passage that communicates between the suction port and the chamber with FIG. 8(*b*) showing a sectional view taken along line II—II in FIG. 8(*a*).
Figure 8:
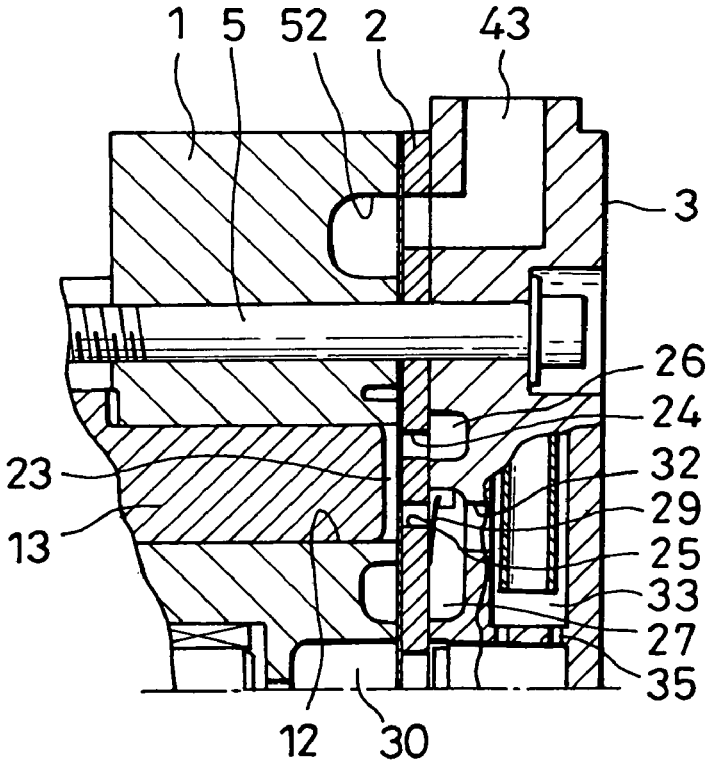

In a further application of the basic structure described above, sub-suction chambers 52 where the working fluid flowing in through the suction port 43 is stored may be disposed between the suction port 43 and the chamber 50, as shown in FIGS. 7 and 8.

Namely, in the structural example presented in FIG. 7, sub-suction chambers 52 are formed by mounting a separate header 53 at the cylinder block 1. The header 53 in FIG. 7 is mounted at the cylinder block astride the area at which a tightening bolt 5 is inserted, a suction port 43 and two sub-suction chambers 52 defined by a reinforcement rib 54 communicating with the suction port 43 are disposed at the header 53 and the sub-suction chambers 52 are each connected to the chamber 50 via a first passage 44 formed to extend on either side of the area at which the tightening bolt 5 is inserted.

In the structural example presented in FIG. 8, a portion of the peripheral edge of the cylinder block 1 is made to distend so as to cover the area at which a tightening bolt 5 is inserted at the cylinder block 1, two sub-suction chambers 52 defined by a reinforcement rib 54 extending from the area at which the tightening bolt 5 is inserted and a first passage 44 connecting each sub-suction chamber to the chamber 50 through either side of the area at which the tightening bolt is inserted are formed at the distended portion and the suction port 43 formed at the rear head is connected to the sub-suction chambers 52 via the valve plate 2. It is to be noted that in either of the structural examples explained above, a single sub-suction chamber 52 may be formed by omitting the reinforcement rib 54.

By adopting either of the structures described above, the working fluid flowing in via the suction port 43 is guided into the chamber 50 via the first passage 44 after traveling through the sub-suction chamber or chambers 52 and, as a result, the extent of suction pulsation can be lowered.

It is to be noted that while the oil tank 30 is disposed near the center of the cylinder block 1 in the examples explained above, the present invention is not limited to this positional arrangement and as long as the oil tank can be cooled with the working fluid taken in through the suction port 43, it may be disposed toward the peripheral edge of the cylinder block 1, as well. In addition, the suction port 43 and the oil separation chamber 30, too, may be disposed at different positions instead of the positions assumed in the explanation given above. Furthermore, the structures described above may be adopted in clutchless compressors.

While an explanation is given above on an example in which the reciprocating compressor is a rotary swashplate compressor, the present invention may instead be adopted in an oscillating swashplate compressor. While the front head 4, the cylinder block 1, the valve plate 2 and the rear head 3 are assembled together by using the tightening bolts 5 in the structure described above, a single ring nut may be used instead of the tightening bolts 5, or they may be assembled together through welding or by using an adhesive, as well.

While the suction chamber 26 and the discharge chamber 27 are formed by locking the rear head 3 onto the cylinder block 1 via the valve plate 2 and the crankcase 6 is formed by locking the front head 4 onto the cylinder block 1 in the compressor in the explanation given above, the suction chamber and the discharge chamber may instead be formed by locking the front head to the cylinder block via the valve plate and the crankcase may be formed by locking the rear head to the cylinder block. Any of the specific structural examples explained earlier may be adopted in such a compressor.

Moreover, the specific structural features of the present invention may be adopted in a compressor having the cylinder block and the second head provided as an integrated unit or in a compressor having the valve plate housed within a groove formed at the cylinder block or the first head (having no tightening bolt holes).

INDUSTRIAL APPLICABILITY

As described above, according to the invention disclosed in claim 1, the lubricating oil separated at the oil separation means is collected in the oil tank and the lubricating oil collected in the oil tank is cooled with the working fluid taken in from the outside and guided into the suction chamber. As a result, the viscosity of the lubricating oil can be kept at a high level to achieve better lubrication.

According to the invention disclosed in claims 2 and 3, part of the oil tank is disposed at the cylinder block and the suction path is provided at the cylinder block so as to surround the oil tank. Thus, the working fluid guided into the suction chamber, which is allowed to flow around the oil tank while flowing through the suction path at the cylinder block, cools the oil tank with a high degree of efficiency.

According to the invention disclosed in claim 4, part of the oil tank is disposed at the first head and the suction chamber is formed at the first head so as to surround the oil tank. Thus, the working fluid flowing through the suction chamber cools the oil tank.

According to the invention disclosed in claim 5, the oil separation means achieves centrifugal separation, the oil separation chamber communicating with the discharge chamber is formed so as to partially overlap with the oil tank and is thus made to communicate with the oil tank, and the lubricating oil having become separated at the oil separation means is guided into the oil tank. Consequently, the lubricating oil can be collected into the oil tank with a high degree of efficiency. In addition, it is not necessary to form a special communicating hole that would be otherwise needed to guide the separated lubricating oil into the oil tank.

According to the invention disclosed in claim 6, a chamber is formed so as to surround the cylinder bores as well and, as a result, the cylinder bores and the pistons inserted therein, too, can be cooled with a high degree of efficiency.

According to the invention disclosed in claim 7, reinforcement ribs are disposed to bridge tubular walls with each other in the structure in which the tubular walls are left so as to define a chamber around the oil tank and the cylinder bores, and thus, deformation of the cylinder bores that would otherwise be induced by the descending load of the pistons can be prevented.

According to the invention disclosed in claims 8 and 9, two lubricating oil path systems are formed to make it possible to supply the lubricating oil in a desirable manner to the specific individual lubrication-requiring portions.

According to the invention disclosed in claim 10, the tightening bolts used to fasten together the cylinder block, the valve plate, the first head and the second head are disposed further outward relative to the cylinder bores at positions achieving the same phase as the phase of the cylinder bores, and thus no obstacle is present in the suction path.

According to the invention disclosed in claim 11, a greater number of tightening bolts compared to the number of cylinder bores is used to fasten together the cylinder block, the valve plate, the first head and the second head. Consequently, the compressor can be provided as a compact unit achieving a high level of pressure withstanding performance and a highly airtight structure. According to the invention disclosed in claim 12, sub-suction chambers where the working fluid flowing in through the suction ports is stored are disposed between the suction port and the chamber so as to lower the extent of the suction pulsation.

The invention claimed is:

1. A reciprocating compressor comprising:

a cylinder block having formed therein a plurality of cylinder bores;

a valve plate having formed therein pairs of holes with each pair constituted of a suction hole and a discharge hole, in correspondence with one of said cylinder bores;

a first head fixed to said cylinder block via said valve plate and having formed therein a suction chamber that is allowed to come into communication with said suction hole and a discharge chamber that is allowed to come into communication with said discharge hole;

a second head fixed to said cylinder block having formed therein a crankcase;

a shaft rotatably disposed so as to pass through said crankcase; and pistons that reciprocally slide inside said cylinder bores as said shaft rotates, characterized in:

that an oil separation means that separates lubricating oil mixed in a working fluid discharged into said discharge chamber and an oil tank in which the lubricating oil having been separated at said oil separation means is stored are provided; and that part of said oil tank is disposed at said cylinder block and a suction path through which the working fluid flows is formed at said cylinder block so as to surround said oil tank to allow the lubricating oil collected in said oil tank to be cooled with a working fluid guided into said suction chamber.

2. A reciprocating compressor according to claim 1, characterized in: that said suction path is constituted with a suction port through which the working fluid is taken in from outside, a chamber formed at said cylinder block so as to surround said oil tank and to open toward said valve plate, a first passage communicating between said suction port and said chamber and a second passage formed at said valve plate and communicating between said chamber and said suction chamber.

3. A reciprocating compressor according to claim 2, characterized in: that said chamber is formed so as to surround said cylinder bores as well.

4. A reciprocating compressor according to claim 3, characterized in: that said chamber is formed by leaving tubular walls around said oil tank and around said cylinder bores; and that reinforcement ribs bridge said tubular walls with each other.

5. A reciprocating compressor according to claim 2, characterized in: that a control passage, the degree of openness of which is adjusted with a pressure control valve is formed between said discharge chamber and said crankcase; that a first lubricating oil supply path formed by opening an end of said control passage facing said crankcase toward a peripheral edge of said swash plate and a second lubricating oil supply path through which the lubricating oil collected in said oil tank is supplied to lubrication-requiring portions around said shaft via a passage formed at said shaft are achieved; and that said crankcase and said chamber are made to communicate with each other via a leak passage formed at said cylinder block.

6. A reciprocating compressor according to claim 2, characterized in: that a control passage, the degree of openness of which is adjusted with a pressure control valve is formed between said discharge chamber and said crankcase; that a first lubricating oil supply path formed by opening an end of said control passage facing said crankcase toward a peripheral edge of said swash plate and a second lubricating oil supply path through which the lubricating oil collected in said oil tank is supplied to lubrication-requiring portions around said shaft via a passage formed at said cylinder block and said second head and also via a passage formed at said shaft communicating with said passage are achieved; and that said crankcase and said chamber are made to communicate with each other via said passage formed at said shaft and a leak passage formed at said cylinder block and communicating with said passage.

7. A reciprocating compressor according to claim 2, characterized in: that a sub-suction chamber in which the working fluid flowing in through said suction port is stored is disposed between said suction port and said chamber.

8. A reciprocating compressor according to claim 1, characterized in: that part of said oil tank is disposed at said first head; and that said suction chamber is formed at said first head so as to surround said oil tank.

9. A reciprocating compressor according to claim 1, characterized in: said oil separation means includes an oil separation chamber communicating with said discharge chamber and achieves centrifugal separation whereby the working fluid having flowed in from said discharge chamber is rotated in said oil separation chamber to separate the lubricating oil, with part of said oil separation chamber made to overlap with said oil tank to achieve communication.

10. A reciprocating compressor according to claim 1, characterized in: that said cylinder block, said valve plate, said first head and said second head are fastened together with tightening bolts; and that said tightening bolts are disposed further outward relative to said cylinder bores at positions with a phase matching the phase of said cylinder bores.

11. A reciprocating compressor according to claim 1, characterized in: that said cylinder block, said valve plate, said first head and said second head are fastened together with tightening bolts; and a greater number of tightening bolts compared to the number of cylinder bores are used.

* * * * *